US009578440B2

(12) United States Patent
Otto et al.

(10) Patent No.: US 9,578,440 B2
(45) Date of Patent: Feb. 21, 2017

(54) METHOD FOR CONTROLLING A SPEAKER ARRAY TO PROVIDE SPATIALIZED, LOCALIZED, AND BINAURAL VIRTUAL SURROUND SOUND

(75) Inventors: Peter Otto, San Diego, CA (US); Suketu Kamdar, San Diego, CA (US); Toshiro Yamada, San Diego, CA (US); Filippo M. Fazi, Southampton (GB)

(73) Assignees: The Regents of the University of California, Oakland, CA (US); University of Southampton, Southampton (GB)

( * ) Notice: Subject to any disclaimer, the term of this patent is extended or adjusted under 35 U.S.C. 154(b) by 593 days.

(21) Appl. No.: 13/885,392

(22) PCT Filed: Nov. 15, 2011

(86) PCT No.: PCT/US2011/060872

§ 371 (c)(1),
(2), (4) Date: Nov. 19, 2013

(87) PCT Pub. No.: WO2012/068174

PCT Pub. Date: May 24, 2012

(65) Prior Publication Data

US 2014/0064526 A1 Mar. 6, 2014

Related U.S. Application Data

(60) Provisional application No. 61/413,868, filed on Nov. 15, 2010.

(51) Int. Cl.
*H04R 1/40* (2006.01)
*H04R 5/04* (2006.01)
(Continued)

(52) U.S. Cl.
CPC ..... *H04S 7/303* (2013.01); *H04R 5/04* (2013.01); *H04S 5/00* (2013.01); *H04R 1/403* (2013.01);
(Continued)

(58) Field of Classification Search
CPC ..... H04S 7/303; H04S 5/00; H04S 2420/01; H04S 2420/13; H04R 5/04; H04R 1/403; H04R 2203/12
(Continued)

(56) References Cited

U.S. PATENT DOCUMENTS 5,862,227 A * 1/1999 Orduna-Bustamante H04S 1/002 381/17
6,307,941 B1 10/2001 Tanner, Jr. et al.
(Continued)

FOREIGN PATENT DOCUMENTS

KR 100574868 B1 4/2006
WO WO 2009156928 A1 * 12/2009

OTHER PUBLICATIONS

Kirkeby et al., Fast Deconvolution of Multichannel Systems Using Regularization, Mar. 2, 1998, IEEE Transactions on Speech and Audio Processing, p. 189-192.*
(Continued)

*Primary Examiner* — Sonia Gay
(74) *Attorney, Agent, or Firm* — Eleanor Musick; Musick Davidson LLP

(57) ABSTRACT

A signal processing method and system are provided for delivering spatialized sound using highly optimized inverse filters to deliver narrow localized beams of sound from the included speaker array. The inventive method can be used to provide private listening areas in a public space and provide spatialization of source material for individual users to create a virtual 3D audio effect. In a binaural mode, a
(Continued)

speaker array provides two targeted beams aimed towards the primary user's ears—one discrete beam for the left ear and one discrete beam for the right ear.

41 Claims, 14 Drawing Sheets

(51) Int. Cl.
*H04S 7/00* (2006.01)
*H04S 5/00* (2006.01)

(52) U.S. Cl.
CPC ..... *H04R 2203/12* (2013.01); *H04S 2420/01* (2013.01); *H04S 2420/13* (2013.01)

(58) Field of Classification Search
USPC ..... 381/300
See application file for complete search history.

(56) References Cited

U.S. PATENT DOCUMENTS

| | | | | |
|---|---|---|---|---|
| 7,164,768 | B2 | 1/2007 | Aylward et al. | |
| 8,050,433 | B2 | 11/2011 | Kim | |
| 2002/0196947 | A1 | 12/2002 | Lapicque | |
| 2004/0223620 | A1* | 11/2004 | Horbach et al. | 381/59 |
| 2005/0135643 | A1 | 6/2005 | Lee et al. | |
| 2007/0109977 | A1* | 5/2007 | Mittal | G10L 21/038 370/260 |
| 2007/0286427 | A1* | 12/2007 | Jung et al. | 381/17 |
| 2008/0004866 | A1* | 1/2008 | Virolainen | G10L 19/008 704/205 |
| 2008/0025534 | A1* | 1/2008 | Kuhn et al. | 381/300 |
| 2009/0060236 | A1* | 3/2009 | Johnston et al. | 381/304 |
| 2009/0116652 | A1* | 5/2009 | Kirkeby et al. | 381/1 |
| 2010/0296678 | A1* | 11/2010 | Kuhn-Rahloff et al. | 381/303 |
| 2010/0322438 | A1* | 12/2010 | Siotis | H03G 9/18 381/98 |
| 2012/0093348 | A1* | 4/2012 | Li | 381/300 |
| 2012/0121113 | A1 | 5/2012 | Li | |
| 2013/0163766 | A1* | 6/2013 | Choueiri | H04R 3/04 381/17 |

OTHER PUBLICATIONS

Aarts et al., A unified approach to low- and high-frequency bandwidth extension, Oct. 2003, Audio Engineering Society, p. 2,6,7, 13, and 14.*

Fazi, Filippo M. & Nelson, Philip A., "Nonuniqueness of the Solution of the Sound Field Reproduction Problem", Proc. of the 2nd International Symposium on Ambisonics and Spherical Acoustics, May 6-7, 2010, Paris, France.

Fazi, Filippo M., et al., "Surround Sound Panning Technique based on a Virtual Microphone Array", Audio Engineering Society 128th Convention, London, UK, May 22-25, 2010, Convention Paper 8119, pp. 1-12.

Fazi, Filippo M., et al., "Surround system based on three dimensional sound field reconstruction", Audio Engineering Society 125th Convention, San Francisco, CA, Oct. 2-5, 2008, Convention Paper 7555, pp. 1-21.

Shin, Mincheol, et al., "Efficient 3D sound field reproduction", Audio Engineering Society 130th Convention, London, UK, May 13-16, 2011, Convention Paper 8404, pp. 1-10.

PCT/US2011/060872—International Search Report and Written Opinion Jun. 25, 2012, pp. 1-9.

Shin, Mincheol, et al., "Control of a dual-layer loudspeaker array for the generation of private sound", Internoise, Aug. 19-22, 2012, New York City, New York.

Nelson, P.A., et al., "Systems for Virtual Sound Imaging", 5th International Universal Communication Symposium, Korea, Republic of KR, Oct. 12-14, 2011.

* cited by examiner

METHOD FOR CONTROLLING A SPEAKER ARRAY TO PROVIDE SPATIALIZED, LOCALIZED, AND BINAURAL VIRTUAL SURROUND SOUND

CROSS-REFERENCE TO RELATED APPLICATIONS

This application is a 371 national stage filing of International Application No. PCT/US2011/060872, filed Nov. 15, 2011, which claims the benefit of the priority of U.S. Provisional Application No. 61/413,868, filed Nov. 15, 2010, the contents of which are incorporated by reference in their entirety.

FIELD OF THE INVENTION

The present invention relates to signal processing for control of speakers and more particularly to a method for signal processing for controlling a speaker array to deliver one or more projected beams for spatialization of sound and sound field control.

BACKGROUND

Systems for virtual reality are becoming increasingly relevant in a wide range of industrial applications. Such systems generally consist of audio and video devices, which aim at providing the user with a realistic perception of a three dimensional virtual environment. Advances in computer technology and low cost cameras open up new possibilities for three dimensional (3D) sound reproduction. A challenge to creation of such systems is how to update the audio signal processing scheme for a moving listener, so that the listener perceives only the intended virtual sound image.

Any sound reproduction system that attempts to give a listener a sense of space must somehow make the listener believe that sound is coming from a position where no real sound source exists. For example, when a listener sits in the "sweet spot" in front of a good two-channel stereo system, it is possible to fill out the gap between the two loudspeakers. If two identical signals are passed to both loudspeakers, the listener will ideally perceive the sound as coming from a position directly in front of him or her. If the input is increased to one of the speakers, the sound will be pulled sideways towards that speaker. This principle is called amplitude stereo, and it has been the most common technique used for mixing two-channel material ever since the two-channel stereo format was first introduced. However, it is intuitively obvious that amplitude stereo cannot create virtual images outside the angle spanned by the two loudspeakers. In fact, even in between the two loudspeakers, amplitude stereo works well only when the angle spanned by the loudspeakers is 60 degrees or less.

Virtual source imaging systems work on the principle that they get the sound right at the ears of the listener. A real sound source generates certain interaural time- and level differences that are used by the auditory system to localize the sound source. For example, a sound source to left of the listener will be louder, and arrive earlier, at the left ear than at the right. A virtual source imaging system is designed to reproduce these cues accurately. In practice, loudspeakers are used to reproduce a set of desired signals in the region around the listener's ears. The inputs to the loudspeakers must be determined from the characteristics of the desired signals, and the desired signals must be determined from the characteristics of the sound emitted by the virtual source.

Binaural technology is often used for the reproduction of virtual sound images. Binaural technology is based on the principle that if a sound reproduction system can generate the same sound pressures at the listener's eardrums as would have been produced there by a real sound source, then the listener should not be able to tell the difference between the virtual image and the real sound source.

A typical surround-sound system, for example, assumes a specific speaker setup to generate the sweet spot, where the auditory imaging is stable and robust. However, not all areas can accommodate the proper specifications for such a system, further minimizing a sweet spot that is already small. For the implementation of binaural technology over loudspeakers, it is necessary to cancel the cross-talk that prevents a signal meant for one ear from being heard at the other. However, such cross-talk cancellation, normally realized by time-invariant filters, works only for a specific listening location and the sound field can only be controlled in the sweet-spot.

A digital sound projector is an array of transducers or loudspeakers that is controlled such that audio input signals are emitted as a beam of sound that can be directed into an arbitrary direction within the half-space in front of the array. By making use of carefully chosen reflection paths, a listener will perceive a sound beam emitted by the array as if originating from the location of its last reflection. If the last reflection happens in a rear corner, the listener will perceive the sound as if emitted from a source behind him or her.

One application of digital sound projectors is to replace conventional surround-sound systems, which typically employ several separate loudspeakers placed at different locations around a listener's position. The digital sound projector, by generating beams for each channel of the surround-sound audio signal, and steering the beams into the appropriate directions, creates a true surround-sound at the listener's position without the need for further loudspeakers or additional wiring. One such system is described in U.S. Patent Publication No. 2009/0161880 of Hooley, et al., the disclosure of which is incorporated herein by reference.

Cross-talk cancellation is in a sense the ultimate sound reproduction problem since an efficient cross-talk canceller gives one complete control over the sound field at a number of "target" positions. The objective of a cross-talk canceller is to reproduce a desired signal at a single target position while cancelling out the sound perfectly at all remaining target positions. The basic principle of cross-talk cancellation using only two loudspeakers and two target positions has been known for more than 30 years. In 1966, Atal and Schroeder used physical reasoning to determine how a cross-talk canceller comprising only two loudspeakers placed symmetrically in front of a single listener could work. In order to reproduce a short pulse at the left ear only, the left loudspeaker first emits a positive pulse. This pulse must be cancelled at the right ear by a slightly weaker negative pulse emitted by the right loudspeaker. This negative pulse must then be cancelled at the left ear by another even weaker positive pulse emitted by the left loudspeaker, and so on. Atal and Schroeder's model assumes free-field conditions. The influence of the listener's torso, head and outer ears on the incoming sound waves is ignored.

In order to control delivery of the binaural signals, or "target" signals, it is necessary to know how the listener's torso, head, and pinnae (outer ears) modify incoming sound waves as a function of the position of the sound source. This information can be obtained by making measurements on "dummy-heads" or human subjects. The results of such measurements are referred to as "head-related transfer functions", or HRTFs.

HRTFs vary significantly between listeners, particularly at high frequencies. The large statistical variation in HRTFs between listeners is one of the main problems with virtual source imaging over headphones. Headphones offer good control over the reproduced sound. There is no "cross-talk" (the sound does not run round the head to the opposite ear), and the acoustical environment does not modify the reproduced sound (room reflections do not interfere with the direct sound). Unfortunately, however, when headphones are used for the reproduction, the virtual image is often perceived as being too close to the head, and sometimes even inside the head. This phenomenon is particularly difficult to avoid when one attempts to place the virtual image directly in front of the listener. It appears to be necessary to compensate not only for the listener's own HRTFs, but also for the response of the headphones used for the reproduction. In addition, the whole sound stage moves with the listener's head (unless head-tracking is used, and this requires a lot of extra processing power). Loudspeaker reproduction, on the other hand, provides natural listening conditions but makes it necessary to compensate for cross-talk and also to consider the reflections from the acoustical environment.

SUMMARY OF THE INVENTION

In one aspect of the present invention, a system and method are provided for three-dimensional (3-D) audio technologies to create a complex immersive auditory scene that fully surrounds the user. New approaches to the reconstruction of three dimensional acoustic fields have been developed from rigorous mathematical and physical theories. The inventive methods generally rely on the use of systems constituted by a multiple number of loudspeakers. These systems are controlled by algorithms that allow real time processing and enhanced user interaction.

The present invention utilizes a flexible algorithm that provides improved surround-sound imaging and sound field control by delivering highly localized audio through a compacted array of speakers. In a "beam mode," different source content can be steered to various angles so that different sound fields can be generated for different listeners according to their location. The audio beams are purposely narrow to minimize leakage to adjacent listening areas, thus creating a private listening experience in a public space. This sound-bending approach can also be arranged in a "binaural mode" to provide vivid virtual surround sound, enabling spatially enhanced conferencing and audio applications.

A signal processing method is provided for delivering spatialized sound in various ways using highly optimized inverse filters to deliver narrow localized beams of sound from the included speaker array. The inventive method can be used to provide private listening areas in a public space, address multiple listeners with discrete sound sources, provide spatialization of source material for a single user (virtual surround sound), and enhance intelligibility of conversations in noisy environments using spatial cues, to name a few applications.

The invention works in two primary modes. In binaural mode, the speaker array produces two targeted beams aimed towards the primary user's ears—one discrete beam for each ear. The shapes of these beams are designed using an inverse filtering approach such that the beam for one ear contributes almost no energy at the user's other ear. This is critical to provide convincing virtual surround sound via binaural source signals. In this mode, binaural sources can be rendered accurately without headphones. The invention delivers a virtual surround sound experience without physical surround speakers as well.

In one aspect of the invention, a method is provided for producing binaural sound from a speaker array in which a plurality of audio signals is received from a plurality of sources and each audio signal is filtered through a left Head-Related Transfer Function (HRTF) and a right HRTF, wherein the left HRTF is calculated based on an angle at which the plurality of audio signals will be transmitted to a left ear of a user; and wherein the right HRTF is calculated based on an angle at which the plurality of audio signals will be transmitted to a right ear of a user. The filtered audio signals are merged through the left HRTF into a left total binaural signal, and merging the audio signals filtered through the right HRTF into a right total binaural signal. The left total binaural signal is filtered through a set of left spatialization filters, wherein a separate left spatialization filter is provided for each speaker in the speaker array, and the right total binaural signal is filtered through a set of right spatialization filters, wherein a separate right spatialization filter is provided for each speaker in the speaker array. The filtered left total binaural signal and filtered right total binaural signal are summed for each respective speaker into a speaker signal, then the speaker signal is fed to the respective speaker in the speaker array and transmitted through the respective speaker to the user.

The invention also works in beamforming or wave field synthesis (WFS) mode, referred to herein as the WFS mode. In this mode, the speaker array provides sound from multiple discrete sources in separate physical locations. For example, three people could be positioned around the array listening to three distinct sources with little interference from each others' signals. This mode can also be used to create a privacy zone for a user in which the primary beam would deliver the signal of interest to the user and secondary beams may be aimed at different angles to provide a masking noise or music signal to increase the privacy of the user's signal of interest. Masking signals may also be dynamically adjusted in amplitude and time to provide optimized masking and lack of intelligibility of user's signal of interest.

In another aspect of the invention, a method is provided for producing a localized sound from a speaker array by receiving at least one audio signal, filtering each audio signal through a set of spatialization filters (each input audio signal is filtered through a different set of spatialization filters), wherein a separate spatialization filter is provided for each speaker in the speaker array so that each input audio signal is filtered through a different spatialization filter, summing the filtered audio signals for each respective speaker into a speaker signal, transmitting each speaker signal to the respective speaker in the speaker array, and delivering the signals to one or more regions of the space (typically occupied by one or multiple users, respectively).

In a further aspect of the invention, a speaker array system for producing localized sound comprises an input which receives a plurality of audio signals from at least one source; a computer with a processor and a memory which determines whether the plurality of audio signals should be processed by a binaural processing system or a beamforming processing system; a speaker array comprising a plurality of loudspeakers; wherein the binaural processing system comprises: at least one filter which filters each audio signal through a left Head-Related Transfer Function (HRTF) and a right HRTF, wherein the left HRTF is calculated based on an angle at which the plurality of audio signals will be transmitted to a left ear of a user; and wherein the right HRTF is calculated based on an angle at which the plurality of audio signals will be transmitted to a right ear of a user; a left combiner which combines all of the audio signals from the left HRTF into a left total binaural signal; a right combiner which combines all of the audio signals from the right HRTF into a right total binaural signal; at least one left spatialization filter which filters the left total binaural signal, wherein a separate left spatialization filter is provided for each loudspeaker in a speaker array; at least one right spatialization filter which filters the right total binaural signal, wherein a separate right spatialization filter is provided for each loudspeaker in the speaker array; a binaural combiner which sums the filtered left total binaural signal and filtered right total binaural signal into a binaural speaker signal for each respective loudspeaker and transmits each binaural speaker signal to the respective loudspeaker; wherein the beamforming processing system comprises: a plurality of beamforming spatialization filters which filters each audio signal, wherein a separate spatialization filter is provided for each loudspeaker in the speaker array; a beamforming combiner which sums the filtered audio signals for each respective loudspeaker into a beamforming speaker signal and transmits each beamforming speaker signal to the respective speaker in the speaker array; wherein the speaker array delivers the respective binaural speaker signal or the beamforming speaker signal through the plurality of loudspeakers to one or more users.

The plurality of audio signals can be processed by the beamforming processing system and the binaural processing system before being delivered to the one or more users through the plurality of loudspeakers.

A user tracking unit may be provided which adjusts the binaural processing system and beamforming processing system based on a change in a location of the one or more users.

The binaural processing system may further comprise a binaural processor which computes the left HRTF and right HRTF in real-time.

The inventive method employs algorithms that allow it to deliver beams configured to produce binaural sound—targeted sound to each ear—without the use of headphones, by using inverse filters and beamforming. In this way, a virtual surround sound experience can be delivered to the user of the system. The inventive system avoids the use of classical two-channel "cross-talk cancellation" to provide superior speaker-based binaural sound imaging.

In a multipoint teleconferencing or videoconferencing application, the inventive method allows distinct spatialization and localization of each participant in the conference, providing a significant improvement over existing technologies in which the sound of each talker is spatially overlapped. Such overlap can make it difficult to distinguish among the different participants without having each participant identify themselves each time he or she speaks, which can detract from the feel of a natural, in-person conversation.

Additionally, the invention can be extended to provide real-time beam steering and tracking of the user's location using video analysis or motion sensors, therefore continuously optimizing the delivery of binaural or spatialized audio as the user moves around the room or in front of the speaker array.

An important advantage of the inventive system is that it is smaller and more portable than most, if not all, comparable speaker systems. Thus, the invention provides a system that is useful for not only fixed, structural installations such as in rooms or virtual reality caves, but also for use in private vehicles, e.g., cars, mass transit, such buses, trains and airplanes, and for open areas such as office cubicles and wall-less classrooms.

DETAILED DESCRIPTION

Figure 1A:
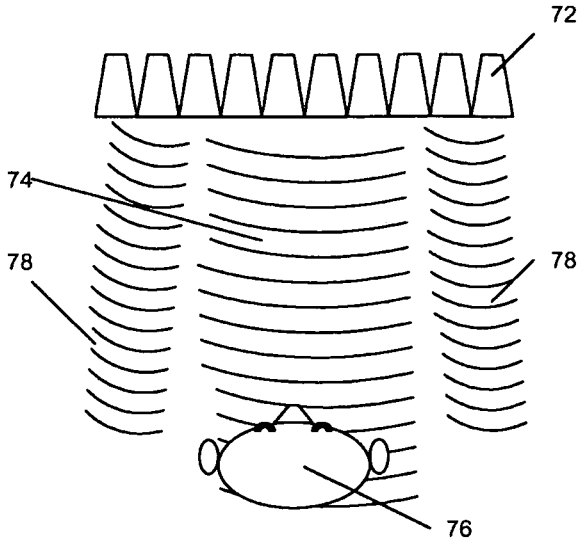
FIG. 1*a* is a diagram illustrating the wave field synthesis (WFS) mode operation used for private listening.

The invention works in two primary modes. In binaural mode, the speaker array provides two targeted beams aimed towards the primary user's ears—one beam for the left ear and one beam for the right ear. The shapes of these beams are designed using an inverse filtering approach such that the beam for one ear contributes almost no energy at the user's other ear. This is critical to provide convincing virtual surround sound via binaural source signals.

The inverse filter design method comes from a mathematical simulation in which a speaker array model approximating the real-world is created and virtual microphones are placed throughout the target sound field. A target function across these virtual microphones is created or requested. Solving the inverse problem using regularization, stable and realizable inverse filters are created for each speaker element in the array. When the source signals are convolved with these inverse filters for each array element, the resulting beams are aimed as desired and as in the simulation.

The invention also works in a second beamforming, or wave field synthesis (WFS), mode. In this mode, the speaker array provides sound from multiple discrete sources to separate physical locations in the same general area. For example, three people may be positioned around the speaker array listening to three distinct sources with little interference from each others' signals. This mode can also be used to provide a privacy zone for a user in which the primary beam would deliver the signal of interest to the user and secondary beams would be aimed at different angles to provide a masking noise, such as white noise or a music signal, to increase the privacy of the user's signal of interest, by preventing other persons located nearby or within the same room from hearing the signal. Masking signals may also be dynamically adjusted in amplitude and time to provide optimized masking and lack of intelligibility of user's signal of interest.

In the privacy zone mode, audio is processed such that the array of speakers can present no sound for most of the listening area due to the narrow beam focus. This is similar to the WFS/beamforming mode, however other lobes of sound signal can exist in addition to the strongest beam. For this mode, importance is placed on silence outside of the listening area. An example of an important application would be audio for a team operating military equipment, such as a tank. Currently, headphones are required for effective communication, but the added weight and limitation on mobility can increase fatigue to the team members. Removing the headphones and using private speaker arrays would be beneficial. Also available in this mode would be private sharing, in which one or more additional listening areas can be established by creation of additional focused audio beams that can be heard by the additional permitted listeners, while still minimizing sound outside of the permitted area.

This WFS mode also uses inverse filters designed from the same mathematical model as described above with regard to creating binaural sounds. Instead of aiming just two beams at the user's ears, this mode uses multiple beams aimed or steered to different locations around the array.

The invention involves a digital signal processing (DSP) strategy that allows for the both binaural rendering and WFS/sound beamforming, either separately or simultaneously in combination.

For both binaural and WFS mode, the signal to be reproduced is processed by filtering it through a set of digital finite impulse response (FIR) filters. These filters are generated by numerically solving an electro-acoustical inverse problem. The specific parameters of the specific inverse problem to be solved are described below. In general, however, the FIR filter design is based on the principle of minimizing, in the least squares sense, a cost function of the type $$J=E+\beta V$$

The cost function is a sum of two terms: a performance error E, which measures how well the desired signals are reproduced at the target points, and an effort penalty $\beta V$, which is a quantity proportional to the total power that is input to all the loudspeakers. The positive real number $\beta$ is a regularization parameter that determines how much weight to assign to the effort term. By varying $\beta$ from zero to infinity, the solution changes gradually from minimizing the performance error only to minimizing the effort cost only. In practice, this regularization works by limiting the power output from the loudspeakers at frequencies at which the inversion problem is ill-conditioned. This is achieved without affecting the performance of the system at frequencies at which the inversion problem is well-conditioned. In this way, it is possible to prevent sharp peaks in the spectrum of the reproduced sound. If necessary, a frequency dependent regularization parameter can be used to attenuate peaks selectively.

The invention works in two primary modes: 1) Wave Field Synthesis (WFS)/beamforming mode and 2) Binaural mode, which are described in detail in the following sections.

Wave Field Synthesis/Beamforming Mode

In WFS modality, the invention generates sound signals for a linear array of loudspeakers, which generate several separated sound beams. In WFS mode operation, different source content from the loudspeaker array can be steered to different angles by using narrow beams to minimize leakage to adjacent areas during listening. As shown in FIG. 1*a*, private listening is made possible using adjacent beams of music and/or noise delivered by loudspeaker array 72. The direct sound beam 74 is heard by the target listener 76, while beams of masking noise 78, which can be music, white noise or some other signal that is different from the main beam 74, are directed around the target listener to prevent unintended eavesdropping by other persons within the surrounding area. Masking signals may also be dynamically adjusted in amplitude and time to provide optimized masking and lack of intelligibility of user's signal of interest as shown in later figures which include the DRCE DSP block.

Figure 1B:
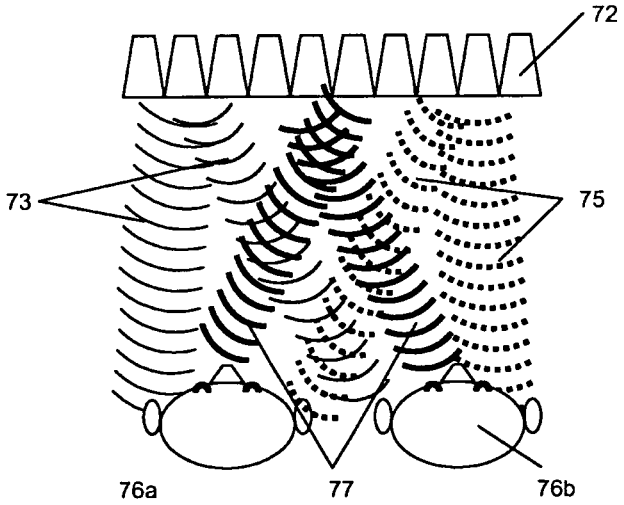
FIG. 1*b* is a diagram illustrating use of WFS mode for multi-user, multi-position audio applications.

In the WFS mode, the speaker array can provide sound from multiple discrete sources to separate physical locations. For example, three people could be positioned around the array listening to three distinct sources with little interference from each others' signals. FIG. 1*b* illustrates an exemplary configuration of the WFS mode for multi-user/multi-position application. As shown, array 72 delivers discrete sounds beams 73, 75 and 77, each with different sound content, to each of listeners 76*a* and 76*b*. While both listeners are shown receiving the same content (each of the three beams), different content can be delivered to one or the other of the listeners at different times.

Figure 2:
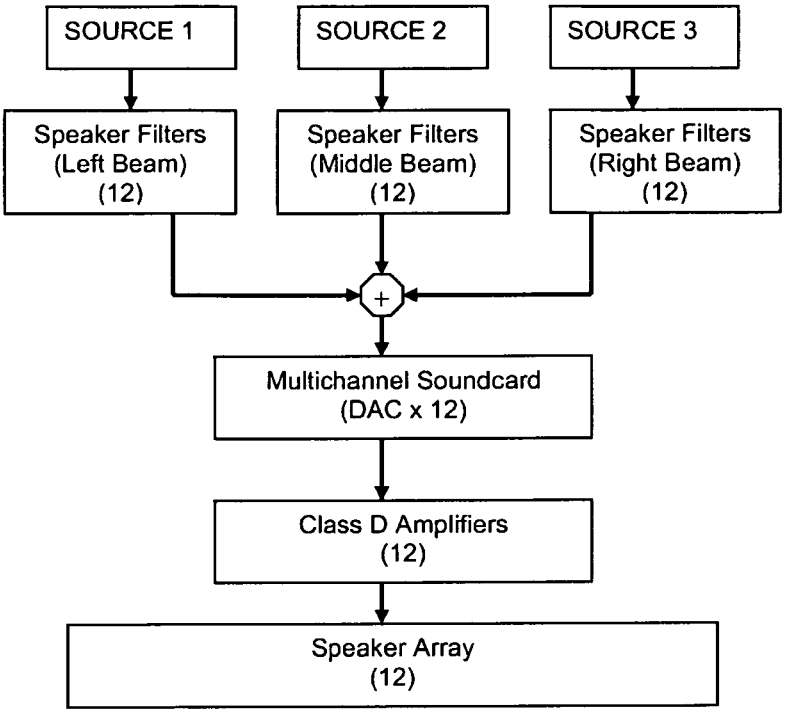
FIG. 2 is a block diagram showing the WFS signal processing chain according to the present invention.

The WFS mode signals are generated through the DSP chain as shown in FIG. 2. Discrete source signals 801, 802 and 803 are each convolved with inverse filters for each of the loudspeaker array elements. The inverse filters are the mechanism that allows that steering of localized beams of audio, optimized for a particular location according to the specification in the mathematical model used to generate the filters. The calculations may be done real-time to provide on-the-fly optimized beam steering capabilities which would allow the users of the array to be tracked with audio. In the illustrated example, the loudspeaker array 812 has twelve elements, so there are twelve filters 804 for each source. The resulting filtered signals corresponding to the same $n^{th}$ loudspeaker are added at combiner 806, whose resulting signal is fed into a multi-channel soundcard 808 with a DAC corresponding to each of the twelve speakers in the array. Each of the twelve signals is amplified using a class D amplifier 810 and delivered to the listener(s) through the twelve speaker array 812.

Figure 3:
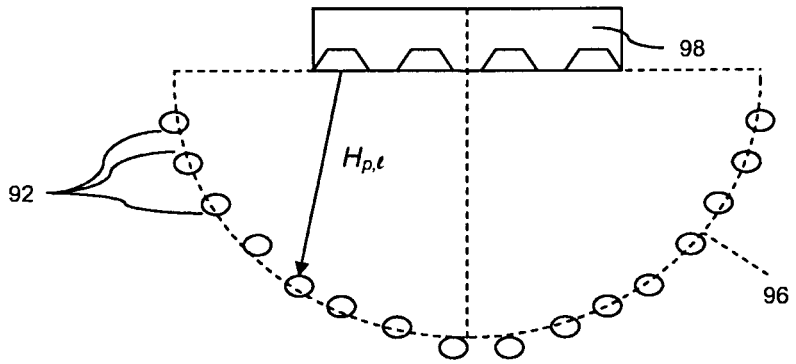
FIG. 3 is a diagrammatic view of an exemplary arrangement of control points for WFS mode operation.

FIG. 3 illustrates how spatialization filters are generated. Firstly, it is assumed that the relative arrangement of the N array units is given. A set of M virtual control points 92 is defined where each control point corresponds to a virtual microphone. The control points are arranged on a semicircle surrounding the array 98 of N speakers and centered at the center of the loudspeaker array. The radius of the arc 96 may scale with the size of the array. The control points 92 (virtual microphones) are uniformly arranged on the arc with a constant angular distance between neighboring points.

An M×N matrix H(f) is computed, which represents the electro-acoustical transfer function between each loudspeaker of the array and each control point, as a function of the frequency f, where $H_{p,l}$ corresponds to the transfer function between the $l^{th}$ speaker (of N speakers) and the $p^{th}$ control point 92. These transfer functions can either be measured or defined analytically from an acoustic radiation model of the loudspeaker. One example of a model is given by an acoustical monopole, given by the following equation $$H_{p,\ell}(f) = \frac{\exp[-j2\pi f r_{p,\ell}/c]}{4\pi r_{p,\ell}}$$

where c is the speed of sound propagation, f is the frequency and $r_{p,l}$ is the distance between the l-the loudspeaker and the $p^{th}$ control point.

A more advanced analytical radiation model for each loudspeaker may be obtained by a multipole expansion, as is known in the art. (See, e.g., V. Rokhlin, "Diagonal forms of translation operators for the Helmholtz equation in three dimensions", *Applied and Computations Harmonic Analysis,* 1:82-93, 1993.)

A vector p(f) is defined with M elements representing the target sound field at the locations identified by the control points 92 and as a function of the frequency f. There are several choices of the target field. One possibility is to assign the value of 1 to the control point(s) that identify the direction(s) of the desired sound beam(s) and zero to all other control points.

The FIR coefficients are defined in the frequency domain and are the N elements of the vector a(f), which is the output of the filter computation algorithm. The vector a is computed by solving, for each frequency f, a linear optimization problem that minimizes the following cost function $$J(f)=\|H(f)a(f)-p(f)\|^2+\beta\|a(f)\|^2$$

The symbol ‖ . . . ‖ indicates the $L^2$ norm of a vector, and β is a regularization parameter, whose value can be defined by the designer. Standard optimization algorithms can be used to numerically solve the problem above.

Figure 4:
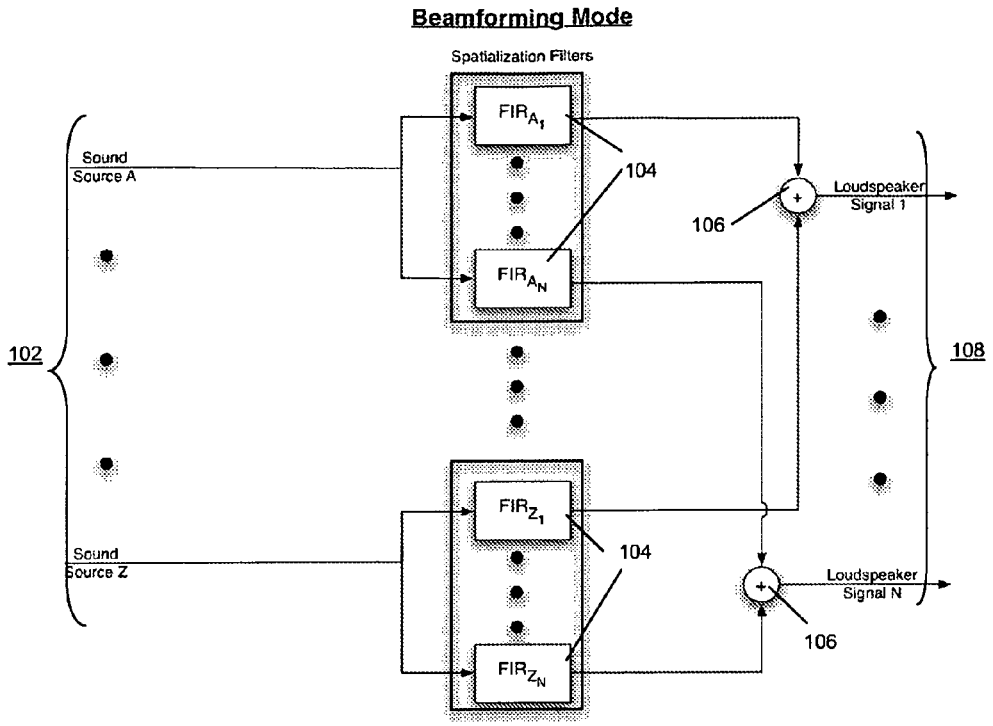
FIG. 4 is a diagrammatic view of a first embodiment of a signal processing scheme for WFS mode operation.

Referring now to FIG. 4, the input to the system is an arbitrary set of audio signals (from A through Z), referred to as sound sources 102. The system output is a set of audio signals (from 1 through N) driving the N units of the loudspeaker array 108. These N signals are referred to as "loudspeaker signals".

For each sound source 102, the input signal is filtered through a set of N FIR digital filters 104, with one filter 104 for each loudspeaker of the array. These digital filters 104 are referred to as "spatialization filters", which are generated by the algorithm disclosed above and vary as a function of the location of the listener(s) and/or of the intended direction of the sound beam to be generated.

For each sound source 102, the audio signal filtered through the $n^{th}$ digital filter 104 (i.e., corresponding to the $n^{th}$ loudspeaker) is summed at combiner 106 with the audio signals corresponding to the different audio sources 102 but to the same $n^{th}$ loudspeaker. The summed signals are then output to loudspeaker array 108.

Figure 5:
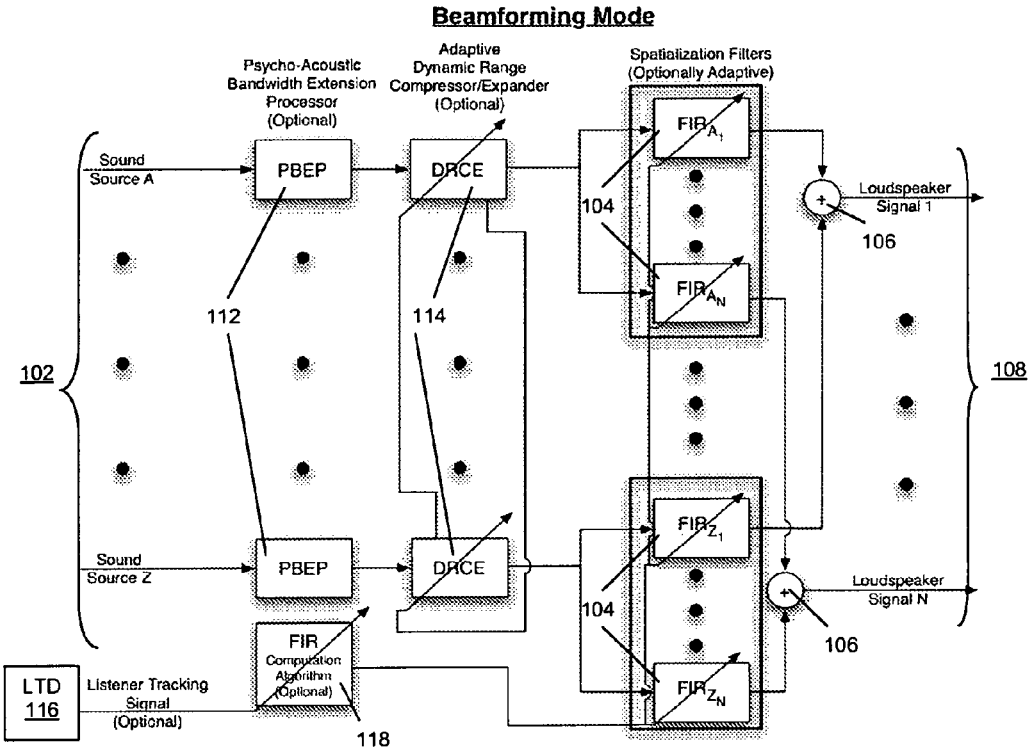
FIG. 5 is a diagrammatic view of a second embodiment of a signal processing scheme for WFS mode operation.
Figure 6A:
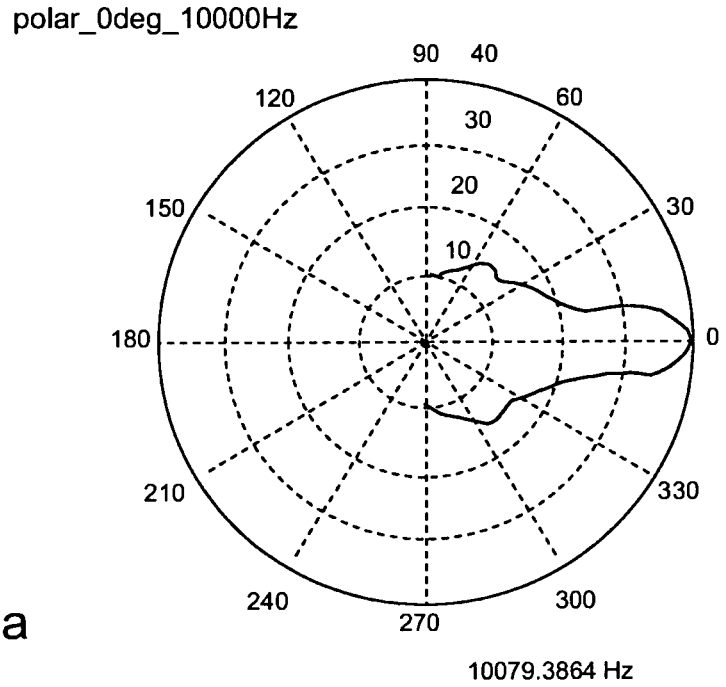
FIGS. 6*a*-6*e* are a set of polar plots showing measured performance of a prototype speaker array with the beam steered to 0 degrees at frequencies of 10000, 5000, 2500, 1000 and 600 Hz, respectively.
Figure 6B:
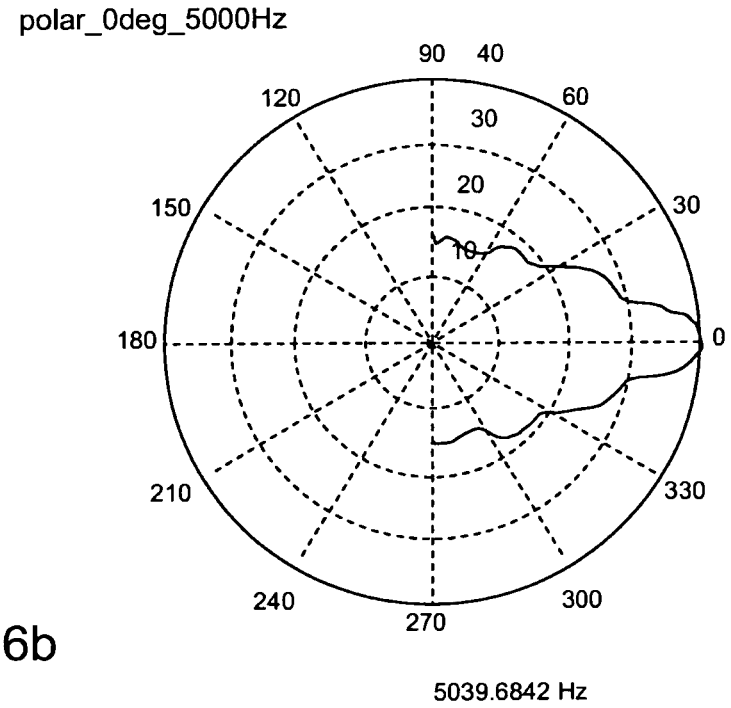
Figure 6C:
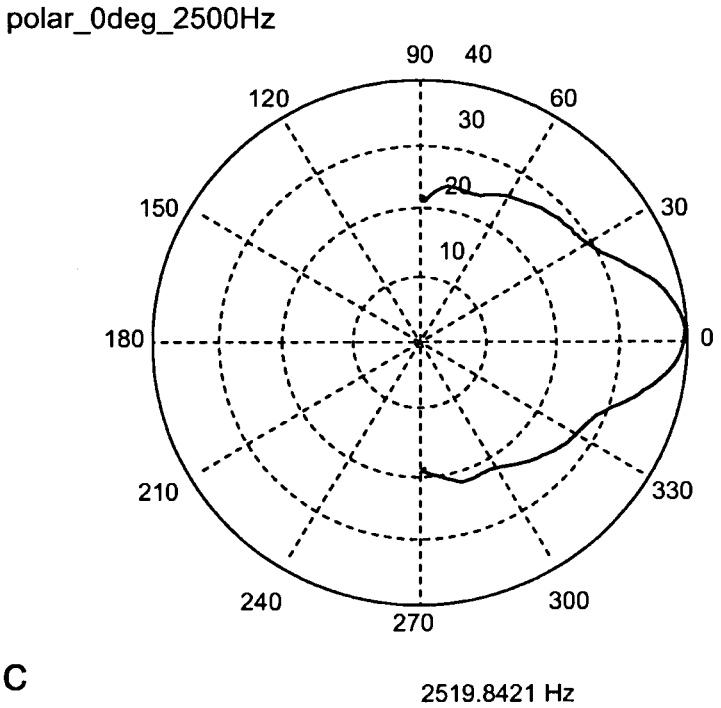
Figure 6D:
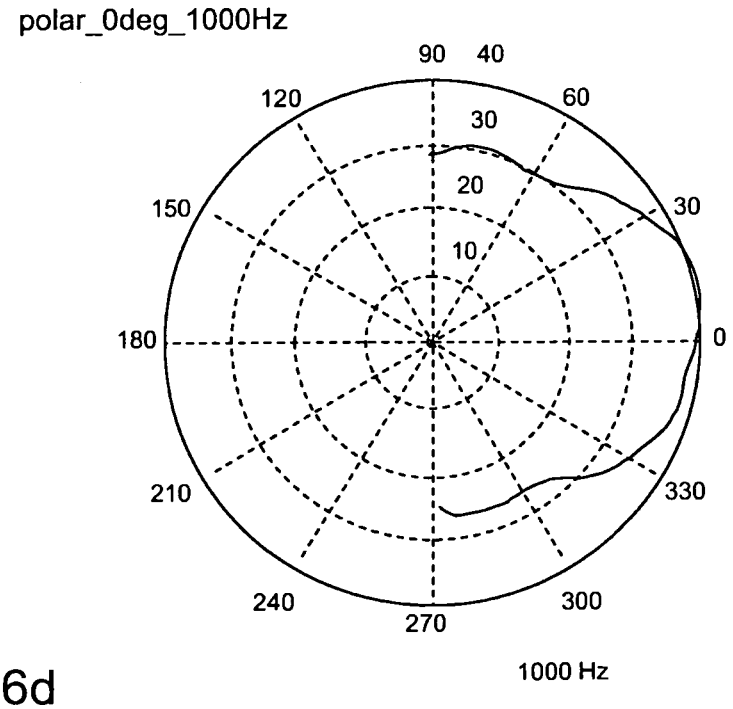
Figure 6E:
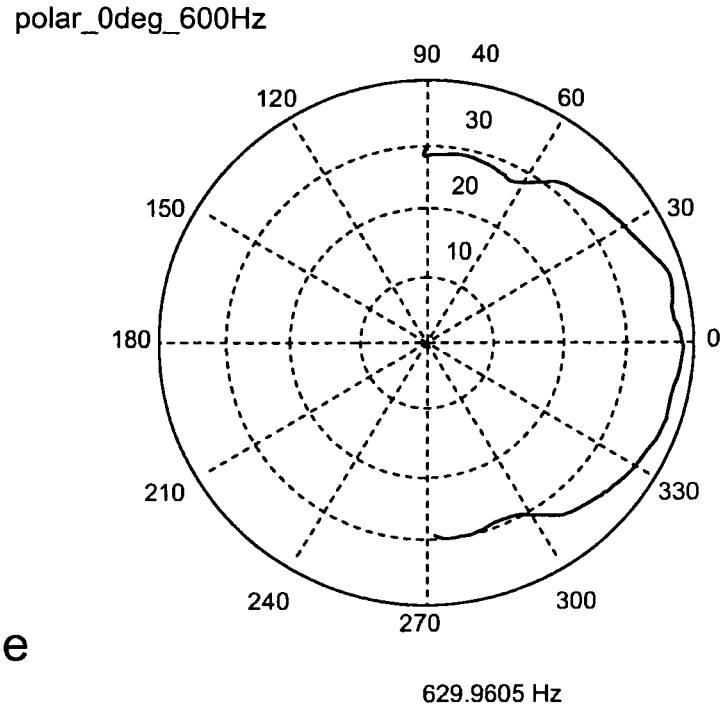

FIG. 5 illustrates an alternative embodiment of the binaural mode signal processing chain of FIG. 4 which includes the use of optional components including a psychoacoustic bandwidth extension processor (PBEP) and a dynamic range compressor and expander (DRCE), which provides more sophisticated dynamic range and masking control, customization of filtering algorithms to particular environments, room equalization, and distance-based attenuation control.

The PBEP 112 allows the listener to perceive sound information contained in the lower part of the audio spectrum by generating higher frequency sound material, providing the perception of lower frequencies using higher frequency sound). Since the PBE processing is non-linear, it is important that it comes before the spatialization filters 104. In fact, the generation of sound beams relies on the control of the interference pattern of the sound fields generated by the units of the array 108. This control is achieved through the spatial filtering process. If the non-linear PBEP block 112 is inserted after the spatial filters, its effect could severely degrade the creation of the sound beam.

It is important to emphasize that the PBEP 112 is used in order to compensate (psycho-acoustically) for the poor directionality of the loudspeaker array at lower frequencies rather than compensating for the poor bass response of single loudspeakers themselves, as is normally done in prior art applications.

The DRCE 114 in the DSP chain provides loudness matching of the source signals so that adequate relative masking of the output signals of the array 108 is preserved. In the binaural rendering mode, the DRCE used is a 2-channel block which makes the same loudness corrections to both incoming channels.

As with the PBEP block 112, because the DRCE 114 processing is non-linear, it is important that it comes before the spatialization filters 104. In fact, the generation of sound beams relies on the control of the interference pattern of the sound fields generated by the units of the array. This control is achieved through the spatial filtering process. If the non-linear DRCE block 114 were to be inserted after the spatial filters 104, its effect could severely degrade the creation of the sound beam. However, without this DSP block, psychoacoustic performance of the DSP chain and array may decrease as well.

Another optional component is a listener tracking device (LTD) 116, which allows the apparatus to receive information on the location of the listener(s) and to dynamically adapt the spatialization filters in real time. The LTD 116 may be a video tracking system which detects the user's head movements or can be another type of motion sensing system as is known in the art. The LTD 116 generates a listener tracking signal which is input into a filter computation algorithm 118. The adaptation can be achieved either by re-calculating the digital filters in real time or by loading a different set of filters from a pre-computed database.

FIGS. 6*a*-6*e* are polar energy radiation plots of the radiation pattern of a prototype array being driven by the DSP scheme operating in WFS mode at five different frequencies, 10,000 Hz, 5,000 Hz, 2,500 Hz, 1,000 Hz, and 600 Hz, and measured with a microphone array with the beams steered at 0 degrees.

Binaural Mode

The DSP for the binaural mode involves the convolution of the audio signal to be reproduced with a set of digital filters representing a Head-Related Transfer Function (HRTF). The integration of these HRTF filters in the DSP scheme, and especially the specific location of these filters in the signal processing scheme, represent a novel approach provided by the present invention.

Figure 7A:
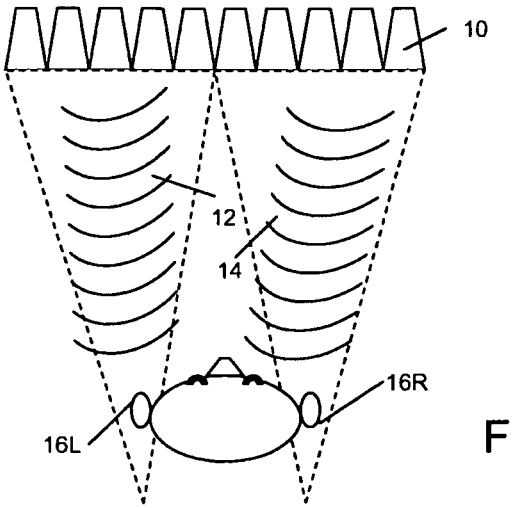
FIG. 7*a* is a diagram illustrating the basic principle of binaural mode operation according to the present invention.
Figure 7B:
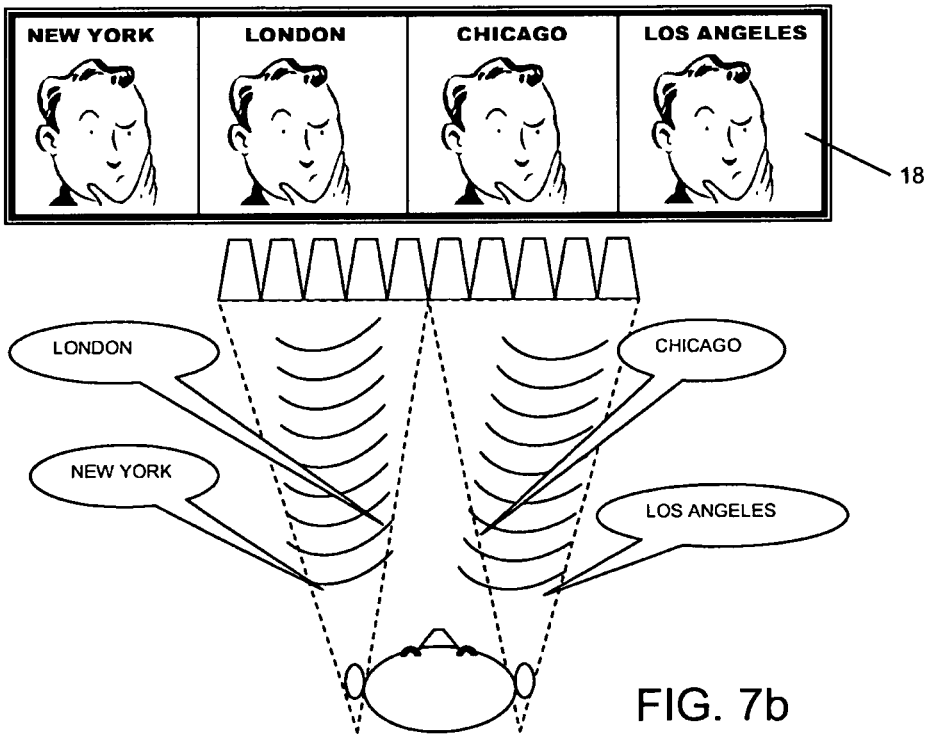
FIG. 7*b* is a diagram illustrating binaural mode operation as used for spatialized sound presentation.

FIG. 7*a* illustrates the underlying approach used in binaural mode operation according to the present invention, where an array a speakers 10 is configured to produce specially-formed audio beams 12 and 14 that can be delivered separately to the listener's ears 16L and 16R. Using the mode, cross-talk cancellation is inherently provided by the beams. The use of binaurally encoded beams enables an effective presentation of spatialized sound, where sounds originating from a first source can be delivered to the listener to sound as if emanating from a different location as a second source. As an example of a spatialized sound application, FIG. 7*b* illustrates a hypothetical video conference call with multiple parties at multiple locations. When the party located in New York is speaking, the sound is delivered as if coming from a direction that would be coordinated with the video image of the speaker in a tiled display 18. When the participant in Los Angeles speaks, the sound may be delivered in coordination with the location in the video display of that speaker's image. On-the-fly binaural encoding can also be used to deliver convincing spatial audio headphones, avoiding the apparent mis-location of the sound that is frequently experienced in prior art headphone set-ups.

Figure 8:
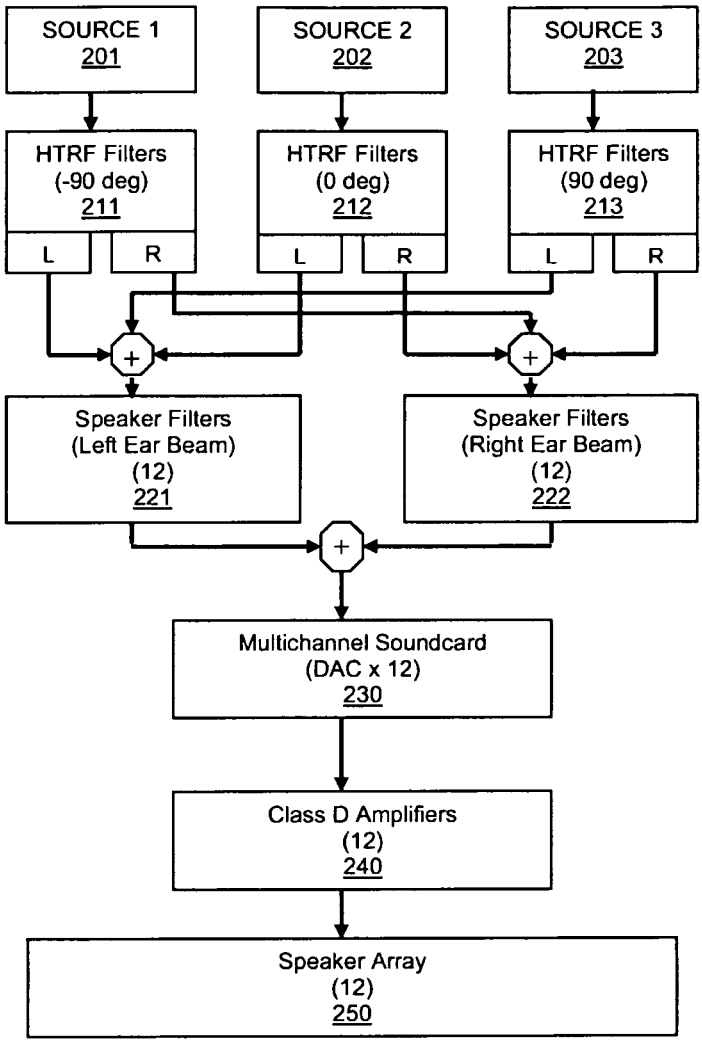
FIG. 8 is a block diagram showing an exemplary binaural mode processing chain according to the present invention.

The binaural mode signal processing chain, shown in FIG. 8, consists of multiple discrete sources, in the illustrated example, three sources: sources 201, 202 and 203, which are then convolved with binaural Head Related Transfer Function (HRTF) encoding filters 211, 212 and 213 corresponding to the desired virtual angle of transmission from the speaker to the user. There are two HRTF filters for each source—one for the left ear and one for the right ear. The resulting HRTF-filtered signals for the left ear are all added together to generate an input signal corresponding to sound to be heard by the user's left ear. Similarly, the HRTF-filtered signals for the user's right ear are added together. The resulting left and right ear signals are then convolved with inverse filter groups 221 and 222, respectively, with one filter for each speaker element in the speaker array, and the resulting total signal is sent to the corresponding speaker element via a multichannel (12×DAC) sound card 230 and class D amplifiers 240 (one for each speaker) for audio transmission to the user through speaker array 250. Each of the speakers in the array (twelve in this example) emits a component that, when combined with the other speakers, produces an audio beam that is configured to be heard at one of the user's ears. In this way, discrete signals meant for the right and left ears can be delivered over optimized beams to the user's ears. This enables a highly realistic virtual surround sound experience without the use of headphones or physical surround speakers.

In the binaural mode, the invention generates sound signals feeding a linear array of loudspeakers. The speaker array provides two targeted sound beams aimed towards the primary user's ears—one beam for the left ear and one beam for the right ear. The shapes of these beams are designed to be such that the beam for one ear contributes almost no energy at the user's other ear.

Figure 9:
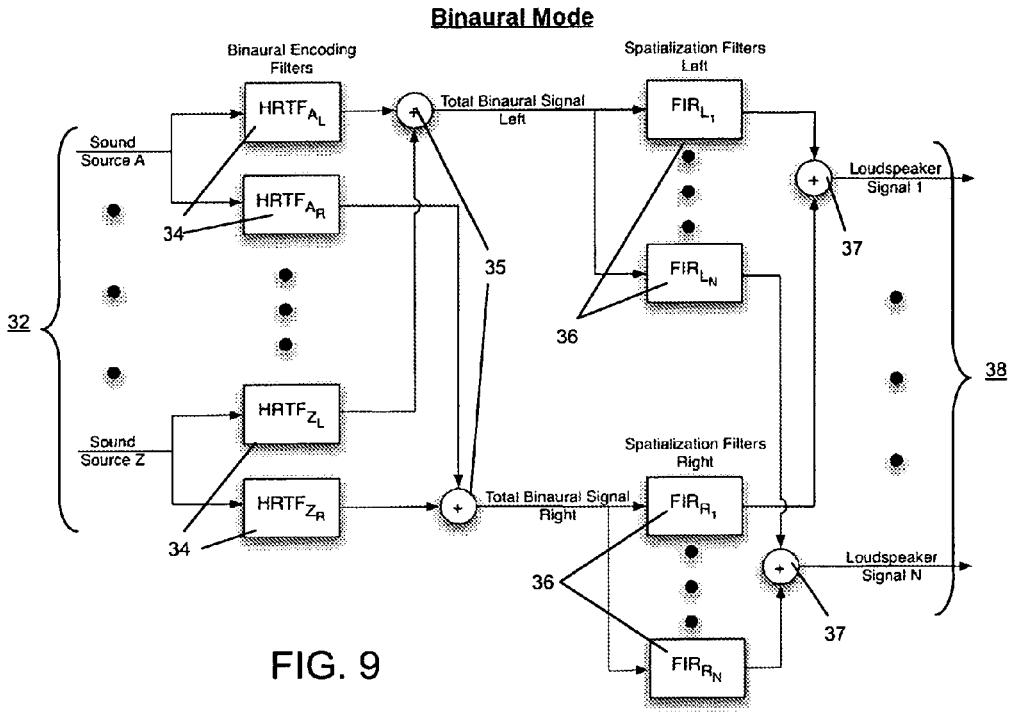
FIG. 9 is a diagrammatic view of a first embodiment of a signal processing scheme for the binaural modality.

FIG. 9 illustrates the binaural mode signal processing scheme for the binaural modality with sound sources A through Z.

As described with reference to FIG. 8, the inputs to the system are a set of sound source signals 32 (A through Z) and the output of the system is a set of loudspeaker signals 38 (1 through N), respectively.

For each sound source 32, the input signal is filtered through two digital filters 34 (HRTF-L and HRTF-R) representing a left and right Head-Related Transfer Function, calculated for the angle at which the given sound source 32 is intended to be rendered to the listener. For example, the voice of a talker can be rendered as a plane wave arriving from 30 degrees to the right of the listener.

The HRTF filters 34 can be either taken from a database or can be computed in real time using a binaural processor.

After the HRTF filtering, the processed signals corresponding to different sound sources but to the same ear (left or right), are merged together at combiner 35 This generates two signals, hereafter referred to as "total binaural signal-left", or "TBS-L" and "total binaural signal-right" or "TBS-R" respectively.

Each of the two total binaural signals, TBS-L and TBS-R, is filtered through a set of N FIR filters 36, one for each loudspeaker, computed using the algorithm disclosed below. These filters are referred to as "spatialization filters". It is emphasized for clarity that the set of spatialization filters for the right total binaural signal is different from the set for the left total binaural signal.

The filtered signals corresponding to the same $n^{th}$ loudspeaker but for two different ears (left and right) are summed together at combiners 37. These are the loudspeaker signals, which feed the array 38.

Figure 10:
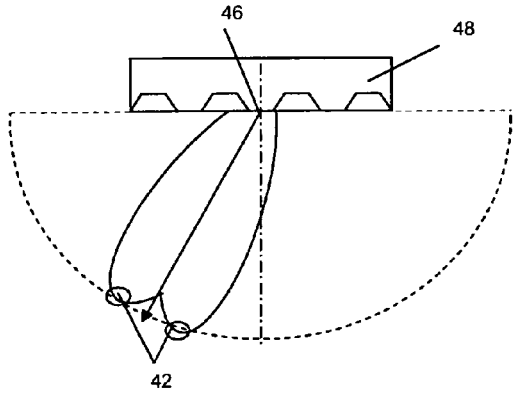
FIG. 10 is a diagrammatic view of an exemplary arrangement of control points for binaural mode operation.

The algorithm for the computation of the spatialization filters 36 for the binaural modality is analogous to that used for the WFS modality described above. The main difference from the WFS case is that only two control points are used in the binaural mode. These control points correspond to the location of the listener's ears and are arranged as shown in FIG. 10. The distance between the two points 42, which represent the listener's ears, is in the range of 0.1 m and 0.3 m, while the distance between each control point and the center 46 of the loudspeaker array 48 can scale with the size of the array used, but is usually in the range between 0.1 m and 3 m.

The 2×N matrix H(f) is computed using elements of the electro-acoustical transfer functions between each loudspeaker and each control point, as a function of the frequency f. These transfer functions can be either measured or computed analytically, as discussed above. A 2-element vector p is defined. This vector can be either [1,0] or [0,1], depending on whether the spatialization filters are computed for the left or right ear, respectively. The filter coefficients for the given frequency f are the N elements of the vector a(f) computed by minimizing the following cost function $$J(f)=\|H(f)a(f)-p(f)\|^2+\beta\|a(f)\|^2$$

If multiple solutions are possible, the solution is chosen that corresponds to the minimum value of the $L^2$ norm of a(f).

Figure 11:
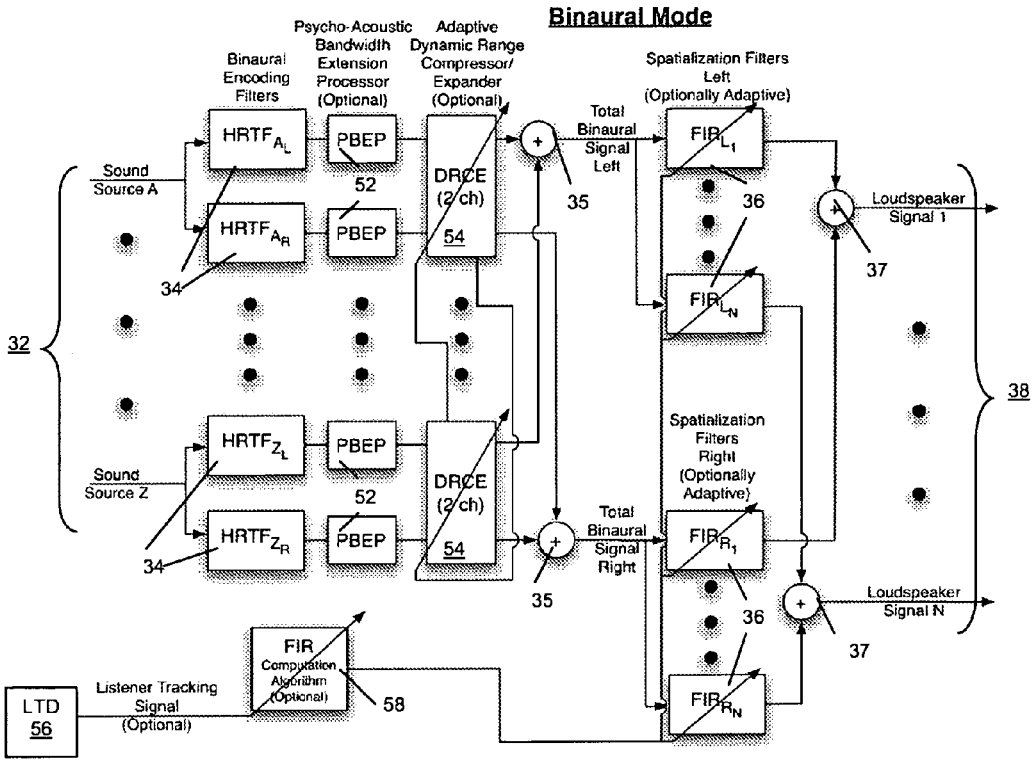
FIG. 11 is a block diagram of a second embodiment of a signal processing chain for the binaural mode.

FIG. 11 illustrates an alternative embodiment of the binaural mode signal processing chain of FIG. 9 which includes the use of optional components including a psychoacoustic bandwidth extension processor (PBEP) and a dynamic range compressor and expander (DRCE). The PBEP 52 allows the listener to perceive sound information contained in the lower part of the audio spectrum by generating higher frequency sound material, providing the perception of lower frequencies using higher frequency sound). Since the PBEP processing is non-linear, it is important that it comes before the spatialization filters 36. In fact, the generation of sound beams relies on the control of the interference pattern of the sound fields generated by the units of the array 38. This control is achieved through the spatial filtering process. If the non-linear PBEP block 52 is inserted after the spatial filters, its effect could severely degrade the creation of the sound beam.

It is important to emphasize that the PBEP 52 is used in order to compensate (psycho-acoustically) for the poor directionality of the loudspeaker array at lower frequencies rather than compensating for the poor bass response of single loudspeakers themselves, as is normally done in prior art applications.

The DRCE 54 in the DSP chain provides loudness matching of the source signals so that adequate relative masking of the output signals of the array 38 is preserved. In the binaural rendering mode, the DRCE used is a 2-channel block which makes the same loudness corrections to both incoming channels.

As with the PBEP block 52, because the DRCE 54 processing is non-linear, it is important that it comes before the spatialization filters 36. In fact, the generation of sound beams relies on the control of the interference pattern of the sound fields generated by the units of the array. This control is achieved through the spatial filtering process. If the non-linear DRCE block 54 were to be inserted after the spatial filters 36, its effect could severely degrade the creation of the sound beam. However, without this DSP block, psychoacoustic performance of the DSP chain and array may decrease as well.

Another optional component is a listener tracking device (LTD) 56, which allows the apparatus to receive information on the location of the listener(s) and to dynamically adapt the spatialization filters in real time. The LTD 56 may be a video tracking system which detects the user's head movements or can be another type of motion sensing system as is known in the art. The LTD 56 generates a listener tracking signal which is input into a filter computation algorithm 58. The adaptation can be achieved either by re-calculating the digital filters in real time or by loading a different set of filters from a pre-computed database.

Figure 12A:
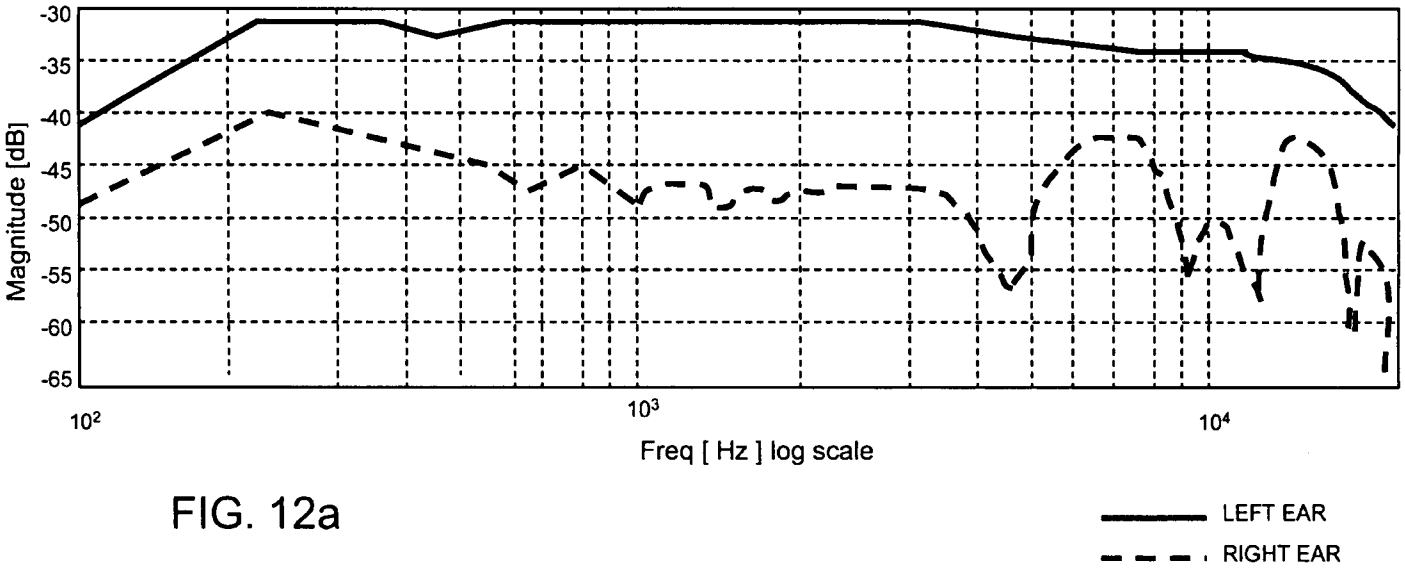
FIGS. 12*a* and 12*b* illustrate simulated frequency domain and time domain representations, respectively, of predicted performance of an exemplary speaker array in binaural mode measured at the left ear and at the right ear.
Figure 12B:
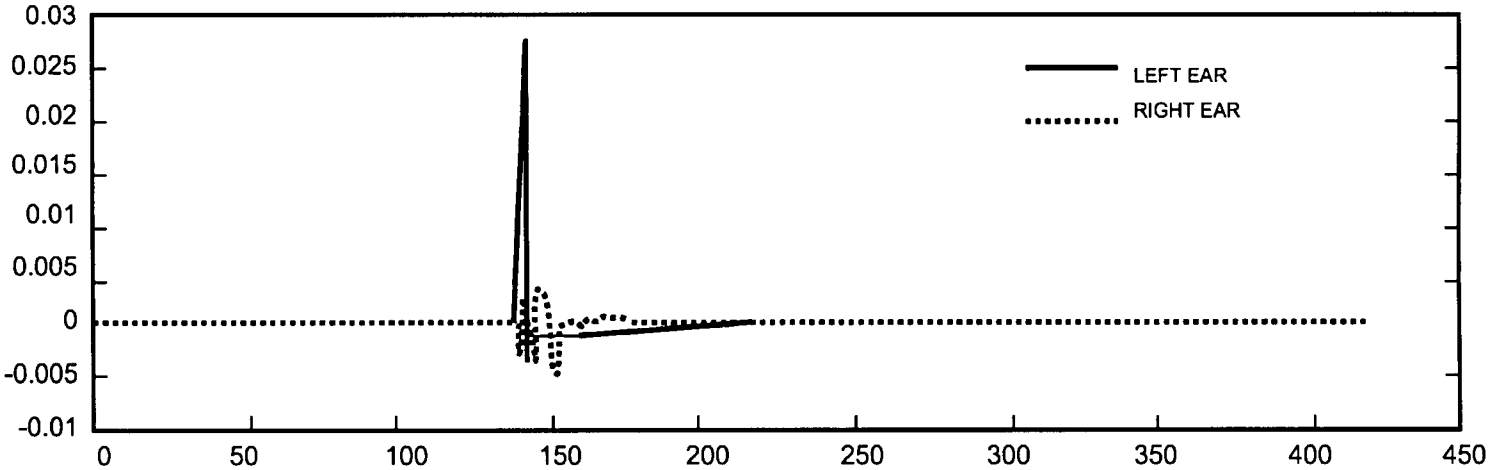

FIGS. 12*a* and 12*b* illustrate the simulated performance of the algorithm for the binaural modes. FIG. 12*a* illustrates the simulated frequency domain signals at the target locations for the left and right ears, while FIG. 12*b* shows the time domain signals. Both plots show the clear ability to target one ear, in this case, the left ear, with the desired signal while minimizing the signal detected at the user's right ear.

WFS and binaural mode processing can be combined into a single device to produce total sound field control. Such an approach would combine the benefits of directing a selected sound beam to a targeted listener, e.g., for privacy or enhanced intelligibility, and separately controlling the mixture of sound that is delivered to the listener's ears to produce surround sound. The device could process audio using binaural mode or WFS mode in the alternative or in combination. Although not specifically illustrated herein, the use of both the WFS and binaural modes would be represented by the block diagrams of FIG. 5 and FIG. 11, with their respective outputs combined at the signal summation steps by the combiners 37 and 106. The use of both WFS and binaural modes could also be illustrated by the combination of the block diagrams in FIG. 2 and FIG. 8, with their respective outputs added together at the last summation block immediately prior to the multichannel soundcard 230.

The DSP strategy described above provides optimal performance in terms of directivity of the sound beam created and of the stability of the binaural rendering at higher frequencies. The inventive methods of sound beam formation are useful in a wide range of applications beyond virtual reality systems. Such applications include virtual/binaural (video) teleconferencing with spatialized talkers; single user binaural/virtual surround sound for games, movies, music; privacy zone/cone of silence for private listening in a public space; multi-user audio from multiple sources simultaneously; targeted and localized audio delivery for enhanced intelligibility in high noise environments; automotive—providing different source material in separate positions within the car simultaneously; automotive—providing binaural audio alerts/cues to assist the driver in driving the vehicle; automotive—providing binaural audio for an immersive spatialized surround sound experience for infotainment systems including spatialized talkers on an in-vehicle conference call. Additional applications will be recognized by those in the art.

The invention claimed is:

1. A method for producing multi-dimensional sound from a speaker array, comprising:

receiving a plurality of audio signals from a plurality of sources;

filtering each audio signal through each of a left Head-Related Transfer Function (HRTF) and a right HRTF to generate HRTF-filtered left and HTRF-filtered right audio signals, wherein the left HRTF is calculated based on an angle at which the plurality of audio signals will be transmitted to a left ear of a user, and wherein the right HRTF is calculated based on an angle at which the plurality of audio signals will be transmitted to a right ear of a user;

filtering each of the HRTF-filtered left and HRTF-filtered right audio signals with a Psychoacoustic Bandwidth Extension Processor (PBEP);

merging the PBEP HRTF-filtered left audio signals into a left total binaural signal;

merging the PBEP HRTF-filtered right audio signals into a right total binaural signal;

filtering the left total binaural signal through a set of left spatialization filters, wherein a separate left spatialization filter is provided for each speaker in the speaker array;

filtering the right total binaural signal through a set of right spatialization filters, wherein a separate right spatialization filter is provided for each speaker in the speaker array;

summing the filtered left total binaural signal and filtered right total binaural signal for each respective speaker into a speaker signal;

feeding the speaker signal to the respective speaker in the speaker array; and transmitting the speaker signal through the respective speaker to the user.

2. The method of claim 1, wherein the left HRTF and right HRTF are computed in real-time using a binaural processor.

3. The method of claim 1, wherein the spatialization filters are finite impulse response (FIR) filters.

4. The method of claim 3, wherein two control points are used to compute the FIR filters, and wherein the distance between the control points is approximately 0.1 meters (m) to approximately 0.3 m.

5. The method of claim 1, further comprising adapting the spatialization filters in real-time based on a change in the location of the user.

6. The method of claim 1, further comprising matching the loudness of the PBEP-filtered audio signals using a Dynamic Range Compressor and Expander (DRCE).

7. A method for producing a localized sound from a speaker array comprising a plurality of speakers, comprising:

receiving at least one audio signal;

pre-filtering the at least one audio signal with a Psychoacoustic Bandwidth Extension Processor (PBEP);

filtering the at least one audio signal through a set of finite impulse response (FIR) filters, wherein a separate FIR filter is provided for each speaker in the speaker array, wherein each FIR filter has filter coefficients a(f) optimized in a frequency domain by minimizing a cost function J for each frequency f according to the relationship $$J(f)=\|H(f)a(f)-p(f)\|^2+\beta\|a(f)\|^2,$$

where H(f) is a M×N matrix of electro-acoustical transfer functions computed for N speakers and M virtual control points, p(f) is a vector representing a target sound field at the M virtual control points as a function of frequency, ||. . . || indicates $L^2$ norm of a vector, and β is a regularization parameter;

summing the filtered audio signals for each respective speaker into a speaker signal;

transmitting each speaker signal to the respective speaker in the speaker array; and delivering each speaker signal to one or more regions of space occupied by one or more users.

8. The method of claim 7, further comprising delivering at least one secondary audio signal to an area around the one or more users which masks the speaker signal in the area not occupied by the one or more users.

9. The method of claim 8, wherein the masking signal is a musical signal.

10. The method of claim 8, further comprising dynamically adjusting the amplitude and time of the masking signals.

11. The method of claim 7, further comprising adapting the FIR filters in real-time based on a change in the location of the one or more users.

12. The method of claim 7, further comprising matching the loudness of the pre-filtered audio signals using a Dynamic Range Compressor and Expander (DRCE).

13. A speaker array system for producing localized sound, comprising:

an input which receives a plurality of audio signals from at least one source;

a processor in communication with a non-transitory computer-readable medium containing instructions configured for causing the processor to determine whether the plurality of audio signals should be processed by a binaural processing system or a beamforming processing system; and a speaker array comprising a plurality of loudspeakers;

wherein the binaural processing system comprises:

at least one filter which filters each audio signal through a left Head-Related Transfer Function (HRTF) and a right HRTF, wherein the left HRTF is calculated based on an angle at which the plurality of audio signals will be transmitted to a left ear of a user; and wherein the right HRTF is calculated based on an angle at which the plurality of audio signals will be transmitted to a right ear of a user;

a left combiner which combines all of the audio signals from the left HRTF into a left total binaural signal;

a right combiner which combines all of the audio signals from the right HRTF into a right total binaural signal;

at least one left spatialization filter which filters the left total binaural signal, wherein a separate left spatialization filter is provided for each loudspeaker in a speaker array;

at least one right spatialization filter which filters the right total binaural signal, wherein a separate right spatialization filter is provided for each loudspeaker in the speaker array; and a binaural combiner which sums the filtered left total binaural signal and filtered right total binaural signal into a binaural speaker signal for each respective loudspeaker and transmits each binaural speaker signal to the respective loudspeaker;

wherein the beamforming processing system comprises:

a plurality of beamforming spatialization filters which filters each audio signal, wherein a separate spatialization filter is provided for each loudspeaker in the speaker array; and a beamforming combiner which sums the filtered audio signals for each respective loudspeaker into a beamforming speaker signal and transmits each beamforming speaker signal to the respective speaker in the speaker array;

wherein the speaker array delivers the respective binaural speaker signal or the beamforming speaker signal through the plurality of loudspeakers to one or more users.

14. The speaker array system of claim 13, wherein the plurality of audio signals can be processed by the beamforming processing system and the binaural processing system before being delivered to the one or more users through the plurality of loudspeakers.

15. The speaker array system of claim 13, further comprising a user tracking unit which adjusts the binaural processing system and beamforming processing system based on a change in a location of the one or more users.

16. The speaker array system of claim 13, wherein the binaural processing system further comprises a binaural processor which computes the left HRTF and right HRTF in real-time.

17. The speaker array system of claim 13, further comprising a left Psychoacoustic Bandwidth Extension Processor (PBEP) disposed between the left HRTF and the left combiner and a right PBEP disposed between the right HRTF and the right combiner.

18. The speaker array system of claim 17, further comprising a left Dynamic Range Compressor and Expander (DRCE) disposed between the left PBEP and the left combiner and a right DRCE disposed between the right HRTF and the right combiner.

19. The speaker array of claim 13 further comprising a combiner configured to sum the binaural speaker signal and the beamforming speaker signal prior to delivery to the plurality of loudspeakers, wherein mixture of the signals is controlled for privacy or enhanced intelligibility.

20. The speaker array system of claim 13, wherein each at least one left spatialization filter, at least one right spatialization filter, and beamforming spatialization filter is a finite impulse response (FIR) filter optimized in a frequency domain by minimizing a cost function J for each frequency according to the relationship J=E+βV, where E is a performance error, and βV is an effort penalty in β is a regularization parameter for weighting effort term V.

21. The speaker array system of claim 3, wherein each FIR filter is optimized in a frequency domain by minimizing a cost function J for each frequency according to the relationship J=E+βV, where E is a performance error, and βV is an effort penalty in which β is a regularization parameter for weighting effort term V.

22. The method of claim 1 further comprising, prior to feeding the speaker signal to the speaker array, combining the speaker signal with a beamforming speaker signal, wherein mixture of the signals is controlled for privacy or enhanced intelligibility.

23. The speaker array system of claim 7, wherein each FIR filter is optimized in a frequency domain by minimizing a cost function J for each frequency according to the relationship J=E+βV, where E is a performance error, and β is an effort penalty in which β is a regularization parameter for weighting effort term V.

24. A method for producing multidimensional sound from a speaker array, comprising:

receiving a plurality of audio signals, each audio signal comprising a plurality of frequencies, from a plurality of sources;

filtering each audio signal through each of a left Head-Related Transfer Function (HRTF) and a right HRTF to generate HRTF-filtered left and HTRF-filtered right audio signals, wherein the left HRTF is calculated based on an angle at which the plurality of audio signals will be transmitted to a left ear of a user, and wherein the right HRTF is calculated based on an angle at which the plurality of audio signals will be transmitted to a right ear of a user;

merging the HRTF-filtered left audio signals into a left total binaural signal;

merging the HRTF-filtered right audio signals into a right total binaural signal;

filtering the left total binaural signal through a set of left finite impulse response (FIR) filters, wherein a separate left FIR filter is provided for each speaker in the speaker array;

filtering the right total binaural signal through a set of right FIR filters, wherein a separate right FIR filter is provided for each speaker in the speaker array;

wherein each FIR filter has filter coefficients optimized in a frequency domain by minimizing a cost function J for each frequency according to the relationship $J(f)=\|H(f)a(f)-p(f)\|^2+\|a(f)\|^2$, where H(f) is a M×N matrix of electro-acoustical transfer functions computed for N speakers and M virtual control points, p(f) is a vector representing a target sound field at the M virtual control points as a function of frequency, ‖. . . ‖ indicates $L^2$ norm of a vector, and β is a regularization parameter;

summing the filtered left total binaural signal and filtered right total binaural signal for each respective speaker into a speaker signal;

feeding the speaker signal to the respective speaker in the speaker array; and transmitting the speaker signal through the respective speaker to the user.

25. The method of claim 24, wherein the left HRTF and right HRTF are computed in real-time using a binaural processor.

26. The method of claim 24, wherein two control points are used to compute the FIR filters, and wherein the distance between the control points is approximately 0.1 meters (m) to approximately 0.3 m.

27. The method of claim 24, further comprising adapting the FIR filters in real-time based on a change in the location of the user.

28. The method of claim 24, further comprising pre-filtering the plurality of audio signals with a Psychoacoustic Bandwidth Extension Processor (PBEP).

29. The method of claim 24, further comprising matching the loudness of the pre-filtered audio signals using a Dynamic Range Compressor and Expander (DRCE).

30. The method of claim 24, further comprising, prior to feeding the speaker signal to the speaker array, combining the speaker signal with a beamforming speaker signal, wherein mixture of the signals is controlled for privacy or enhanced intelligibility.

31. The method of claim 24, wherein M is two and the virtual control points comprise a listener's ears.

32. The method of claim 24, wherein M is a multiple of two and the virtual control points comprise multiple listener's ears.

33. A method for producing a localized sound from a speaker array comprising a plurality of speakers, comprising:

receiving at least one audio signal comprising a plurality of frequencies;

filtering the at least one audio signal through a set of finite impulse response (FIR) filters, wherein a separate FIR filter is provided for each speaker in the speaker array, wherein each FIR filter has filter coefficients a(f) optimized in a frequency domain by minimizing a cost function J for each frequency f according to the relationship $$J(f)=\|H(f)a(f)-p(f)\|^2+\beta\|a(f)\|^2,$$

where H(f) is a M×N matrix of electro-acoustical transfer functions computed for N speakers and M virtual control points, p(f) is a vector representing a target sound field at the M virtual control points as a function of frequency, ‖. . . ‖ indicates $L^2$ norm of a vector, and β is a regularization parameter;

summing the filtered audio signals for each respective speaker into a speaker signal;

transmitting each speaker signal to the respective speaker in the speaker array; and delivering each speaker signal to one or more regions of space occupied by one or more users.

34. The method of claim 33, further comprising delivering at least one secondary audio signal to an area around the one or more users which masks the speaker signal in the area not occupied by the one or more users.

35. The method of claim 34, wherein the at least one secondary audio signal is a musical signal.

36. The method of claim 35, further comprising dynamically adjusting the amplitude and time of the at least one secondary audio signal.

37. The method of claim 33, further comprising adapting the FIR filters in real-time based on a change in the location of the one or more users.

38. The method of claim 33, further comprising pre-filtering the plurality of audio signals with a Psychoacoustic Bandwidth Extension Processor (PBEP).

39. The method of claim 33, further comprising matching the loudness of the pre-filtered audio signals using a Dynamic Range Compressor and Expander (DRCE).

40. The method of claim 33, wherein M is two and the virtual control points comprise a listener's ears.

41. The method of claim 33, wherein M is a multiple of two and the virtual control points comprise multiple listener's ears.

* * * * *